US008408607B2

(12) United States Patent
Michael et al.

(10) Patent No.: US 8,408,607 B2
(45) Date of Patent: Apr. 2, 2013

(54) ANIMAL-RESISTANT CONTAINER

(75) Inventors: William J. Michael, Prescott, AZ (US); Reed A. Davis, Prescott, AZ (US)

(73) Assignee: Northland Products, Inc., Prescott, AZ (US)

( * ) Notice: Subject to any disclaimer, the term of this patent is extended or adjusted under 35 U.S.C. 154(b) by 316 days.

(21) Appl. No.: 12/834,683

(22) Filed: Jul. 12, 2010

(65) Prior Publication Data

US 2012/0006838 A1 Jan. 12, 2012

(51) Int. Cl.
*E05C 19/10* (2006.01)
*E05C 19/00* (2006.01)

(52) U.S. Cl. ..... 292/95; 292/121; 292/252; 296/101; 414/407; 414/408; 220/730

(58) Field of Classification Search ..... 292/95, 292/96, 98, 100, 121, 122, 124, 126, 252; 296/101; 220/324, 326, 730, 833, 835; 414/407, 414/408
See application file for complete search history.

(56) References Cited

U.S. PATENT DOCUMENTS

| | | | | | |
|---|---|---|---|---|---|
| 1,564,593 | A * | 12/1925 | Lawrence | 292/96 |
| 4,182,530 | A * | 1/1980 | Hodge | 294/68.26 |
| 4,863,053 | A * | 9/1989 | Oberg | 414/407 |
| 5,007,786 | A * | 4/1991 | Bingman | 414/409 |
| 5,230,393 | A * | 7/1993 | Mezey | 177/139 |
| 5,505,576 | A * | 4/1996 | Sizemore et al. | 414/409 |
| 5,638,977 | A | 6/1997 | Bianchi | |
| 5,776,405 | A | 7/1998 | Prout et al. | |
| 5,922,267 | A | 7/1999 | Brescia et al. | |
| 6,547,289 | B1 * | 4/2003 | Greenheck et al. | 292/126 |
| 6,550,824 | B1 * | 4/2003 | Ramsauer | 292/126 |
| 6,550,827 | B1 * | 4/2003 | Tsujino | 292/252 |
| 6,612,625 | B1 * | 9/2003 | Barber et al. | 292/87 |
| 6,644,906 | B2 * | 11/2003 | Bayne | 414/408 |
| 6,808,080 | B2 * | 10/2004 | Spiers et al. | 220/263 |
| 7,038,585 | B2 * | 5/2006 | Hall et al. | 340/539.22 |
| 7,048,347 | B1 * | 5/2006 | Liu | 312/332.1 |
| 7,128,233 | B2 | 10/2006 | Hogan | |
| 7,128,515 | B2 * | 10/2006 | Arrez et al. | 414/408 |
| 7,277,009 | B2 * | 10/2007 | Hall et al. | 340/539.22 |
| 7,559,735 | B2 * | 7/2009 | Pruteanu et al. | 414/409 |
| 7,681,752 | B2 | 3/2010 | Moore | |
| 7,871,233 | B2 * | 1/2011 | Arrez et al. | 414/408 |
| 8,056,943 | B2 * | 11/2011 | Scheffy et al. | 292/95 |
| 2002/0030595 | A1 * | 3/2002 | Kasik | 340/568.1 |

OTHER PUBLICATIONS

Bear-Resistant Containers, http://www.bearaware.bc.ca/bear-resistant-bins.html, downloaded Jun. 24, 2010.

* cited by examiner

*Primary Examiner* — Carlos Lugo
(74) *Attorney, Agent, or Firm* — Schmeiser, Olsen & Watts LLP; Lowell W. Gresham; Charlene R. Jacobsen

(57) ABSTRACT

An animal-resistant container includes a body and a lid. The body has an interior volume in which refuse may be placed. At least one latch mechanism is secured in the body and at least one latch receptacle is secured in the lid. The latch mechanism is engaged with the latch receptacle to secure the lid to the body and prevent access to the interior volume. The latch mechanism can be actuated by a gripping arm of a refuse pickup vehicle to release the latch mechanism from the latch receptacle so that contents of the container can be emptied during automated collection. A tilt sensor detects tilting movement of the container, and the latch mechanism is prevented from actuation following detection of the tilting movement so that an animal intruder cannot tip over the container and gain entry into the container.

12 Claims, 10 Drawing Sheets

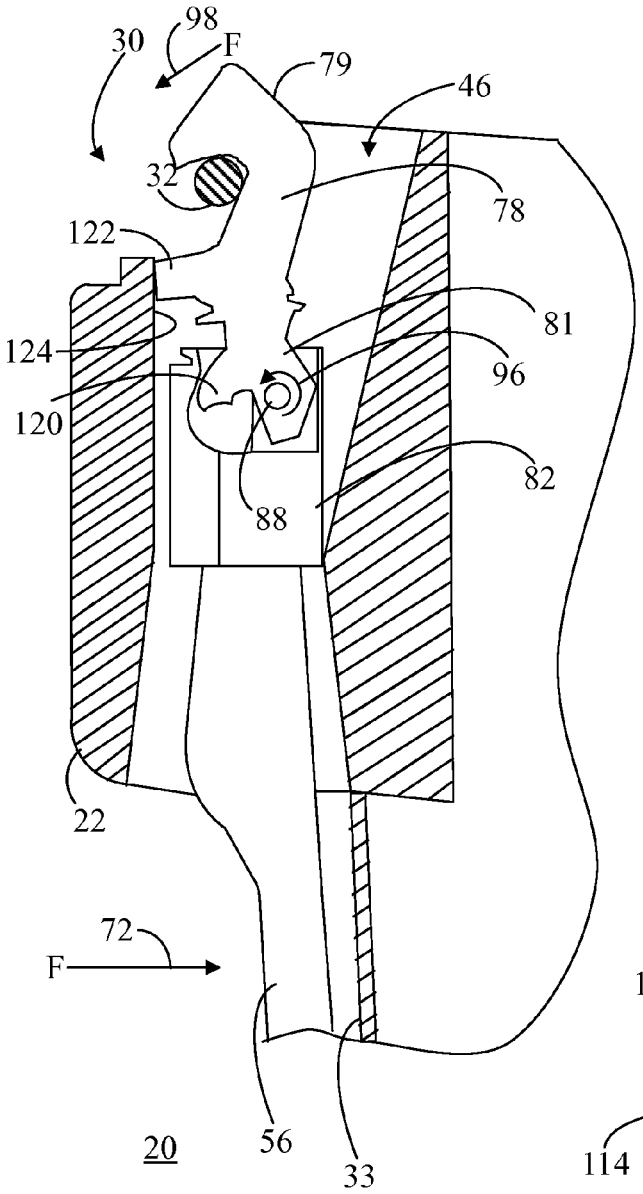
FIG. 17
FIG. 18
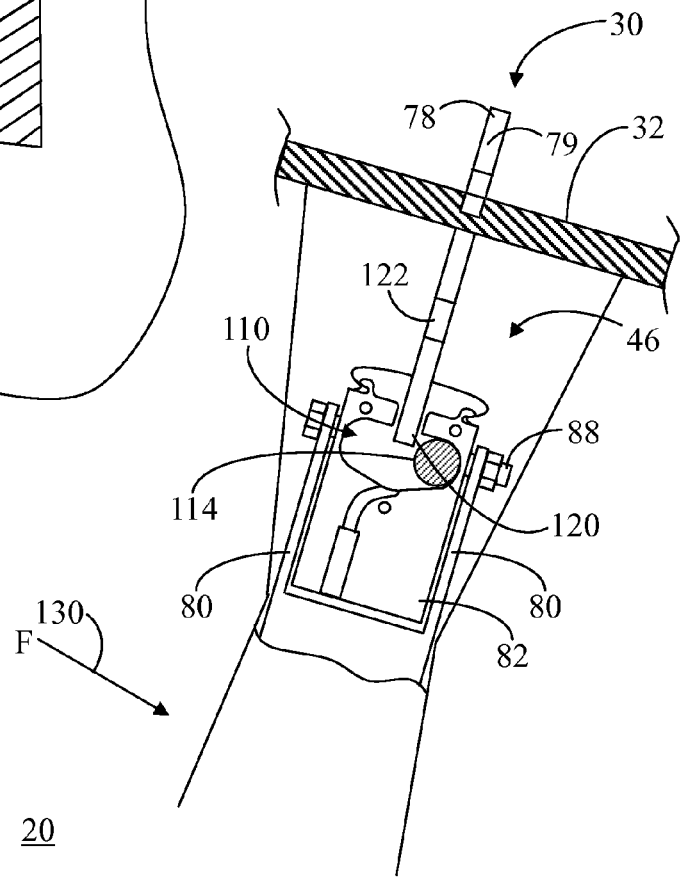

ANIMAL-RESISTANT CONTAINER

TECHNICAL FIELD OF THE INVENTION

The present invention relates to the field of containers. More specifically, the present invention relates to an animal-resistant container configured to selectively restrict access therein.

BACKGROUND OF THE INVENTION

Food and food-containing refuse generated by humans often attracts the attention of animals in areas adjacent to animal habitats. Animals, such as bears, have a keen sense of smell and can easily detect food which has been discarded in containers left outdoors such as refuse bins and storage lockers. Once food has been discovered in such areas, the animals often return to these outdoor containers in the hope of finding additional food.

Animals in pursuit of a readily available source of food are problematic to human populated areas. For example, animals sometimes enter homes, garages, or even vehicles in search of food. Some animals, and bears in particular, can do significant property damage due to their size and strength. Furthermore, animals entering human inhabited areas can become injured or killed by moving vehicles, electrical lines, and other human accoutrements. Still further, these animals can lose their wariness towards humans, making them a potential threat to humans. Indeed, allowing bears to get into the garbage is one of the leading causes of bear-human encounters. Thus, to protect people, property, and the animals themselves, it is desirable to inhibit animals from accessing containers in which refuse and food are stored.

Various attempts have been made to prevent animals from getting into outdoor refuse containers and food storage lockers. For example, refuse containers are sometimes stored inside sturdy locked buildings, in roofed chain link enclosures, and so forth. Unfortunately, food refuse in an enclosure still gives off orders that attract bears and other wildlife. Thus, it is critical that such an enclosure be locked and that the enclosure is sufficiently sturdy to dissuade a persistent intruder.

In addition, or alternatively, refuse containers may be outfitted with a latch system to prevent an animal from opening the container. These latch systems can be problematic, however, because they can be difficult for a user to manipulate. Furthermore, these latch systems typically require the user to unlatch and subsequently re-engage the latch after use. If the latch is not re-engaged the container is not protected from animal access. Additionally, some latch systems can still be opened by animals through luck, persistence, or cleverness.

Another approach is to build the container using heavy, reinforcing components designed to inhibit animals from physically damaging the container in order to gain access. These reinforcing components can make the container undesirably heavy and unwieldy to move. In addition, these heavy, reinforcing components can cause premature damage, such as failure of the container hinges after repeated use.

In an effort to control costs associated with refuse collection, many municipalities are implementing "fully-automated collection" techniques. Fully-automated collection involves the use of a truck with an automated, mechanical gripping arm to lift a specially-designed container from the curbside, dump the container contents into the truck, and return the container to the curbside. Such a system typically requires only one person to operate because the truck driver controls the gripping arm from the cab of the truck. In contrast, traditional collection systems require one or two laborers and a driver to collect refuse.

Fully-automated collection relies on the cooperation of the residents to place the refuse containers in the proper location and position for collection. Unless the resident places the refuse container in the proper location at the moment that the truck approaches, a container without a latch system is vulnerable to animals while the container awaits refuse collection. A container with a latch system is also problematic because when the container is placed in the proper location, it must be unlatched so that the contents of the container will be successfully emptied. Accordingly, a container with a disengaged latch system is also vulnerable to animals while the container awaits refuse collection. Alternatively, the refuse vehicle operator may exit the truck to disengage the latch system. However, such a procedure is undesirably inconvenient and time consuming. A container using heavy, reinforcing components may be difficult for a resident to place in the proper location and may not conform with the size, shape, and weight requirements needed to safely function with the automated, mechanical arm.

Accordingly, what is needed is an animal-resistant container that is easy to use, mechanically robust, and is compatible with fully-automated collection systems.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 17 shows a partial side view of the container with the latch mechanism engaged with the latch receptacle when the container is tipped; and FIG. 18 shows a partial front view of the container with the latch mechanism engaged with the latch receptacle when the container is tipped.

DETAILED DESCRIPTION OF THE PREFERRED EMBODIMENTS

Embodiments of the invention include an animal-resistant container, and more particularly, an animal-resistant refuse container. Such a refuse container is useful for receiving and holding garbage, trash, recyclable items, and the like. The refuse container includes a latch system configured to inhibit an animal, and especially large animals such as bears, peccaries, and the like, from accessing the contents of the container. The latch system automatically engages so that a user need not deliberately re-engage the latch after placing refuse in the container. Furthermore, the latch system can be unlatched by an automated, mechanical arm of a refuse truck so that the contents of the container can be emptied during automated collection. Additionally, upon detection of tilting or tipping of the container, the latch system will remain engaged to prevent an animal intruder from access into the container. Although the animal-resistant system is directed towards inhibiting access of animals to a refuse container used for automated collection, embodiments of the invention may be applied to inhibiting access of animals in general to containers.

Figure 1:
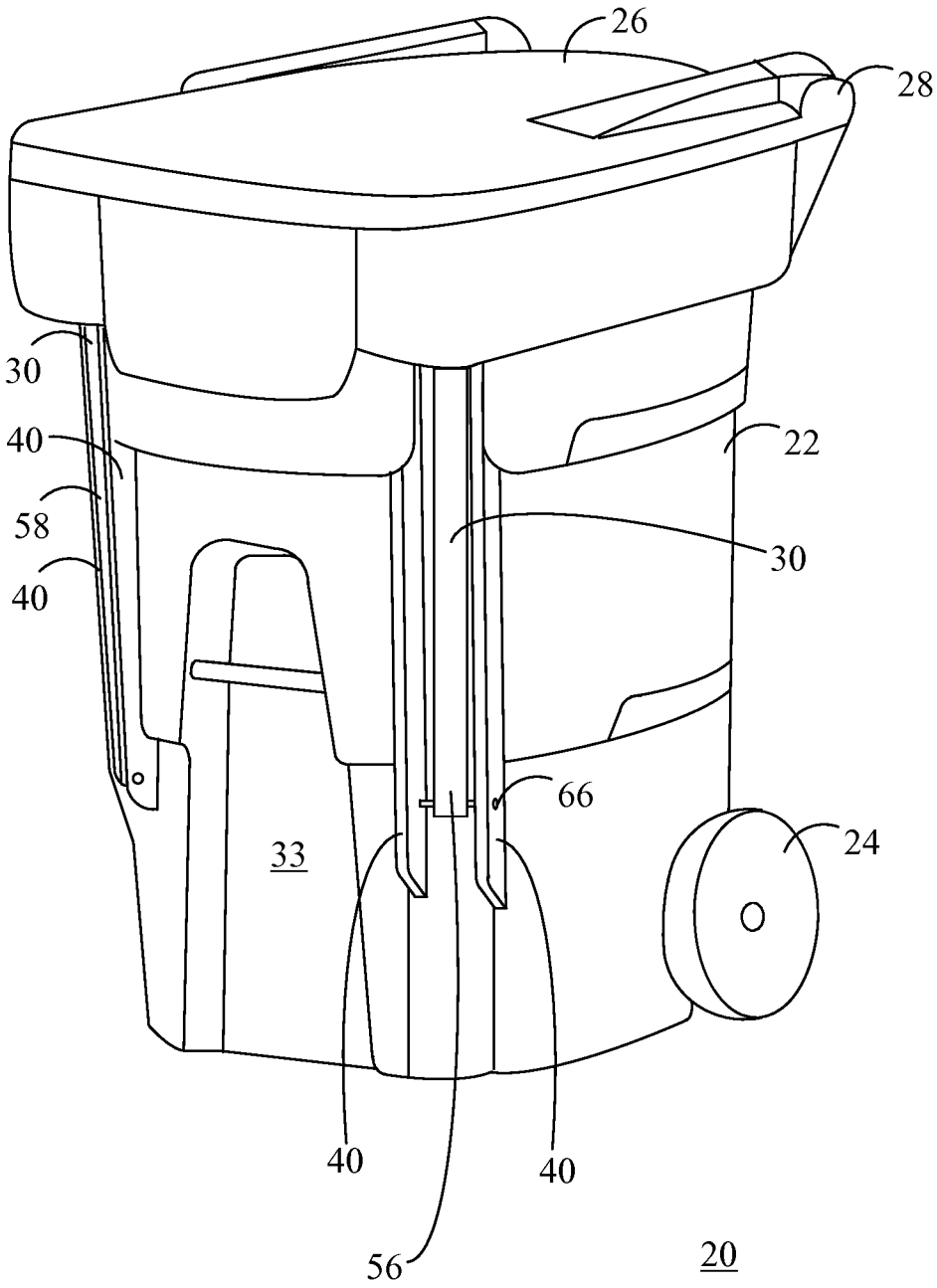
FIG. 1 shows a perspective view of an animal-resistant container in accordance with an embodiment of the present invention.

FIG. 1 shows a perspective view of an animal-resistant container 20 in accordance with an embodiment of the present invention. In general, container 20 includes a body 22 mounted on wheels 24 (of which one is visible), and a lid 26 attached to body 22. For example, lid 26 may be pivotally attached to a handlebar 28 so that lid 26 can be opened to access an interior of body 22. Container 20 further includes at least one latch mechanism 30 secured in body 22 and at least one latch receptacle 32 (visible in FIGS. 4 and 5) secured in lid 26.

In an embodiment, animal-resistant container 20 includes two latch mechanisms 30 and, correspondingly, two latch receptacles 32. Each of latch mechanisms 30 and the corresponding latch receptacles 32 are spaced apart from one another and are located at an exterior front surface 33 of body 22 of container 20, for example, at opposing front corners of exterior front surface 33. Each latch mechanism 30 functions cooperatively with its corresponding latch receptacle 32 so that lid 26 is secured to body 22 to inhibit intrusion into animal-resistant container 20, as will be discussed in greater detail below. In addition, latch mechanisms 30 can be reliably actuated by the gripping arm of an automated collection refuse pickup vehicle to disengage them from latch receptacles 32, as will also be discussed in greater detail below.

Figure 2:
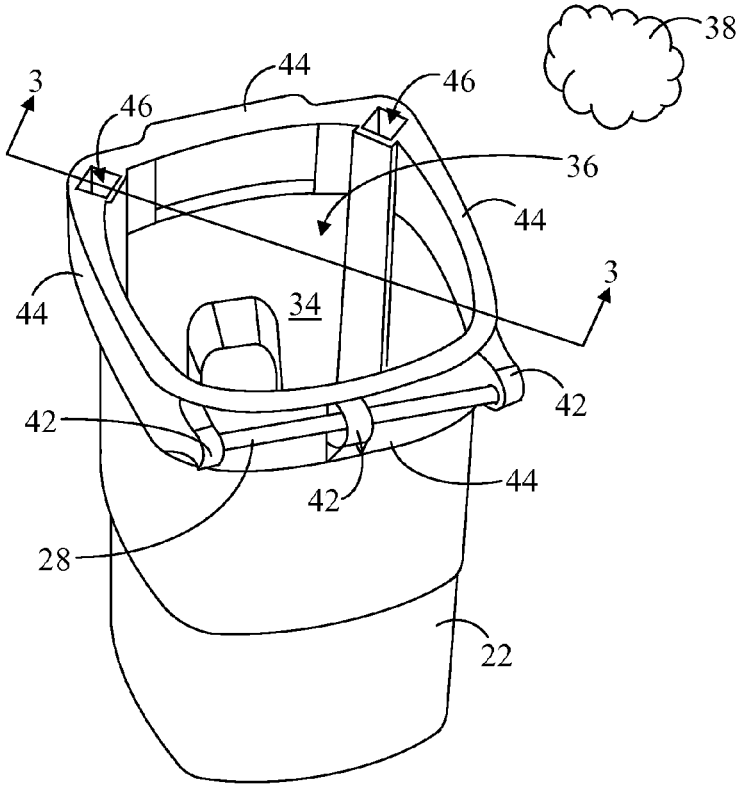
FIG. 2 shows a top perspective view of a body of the animal-resistant container of FIG. 1.
Figure 3:
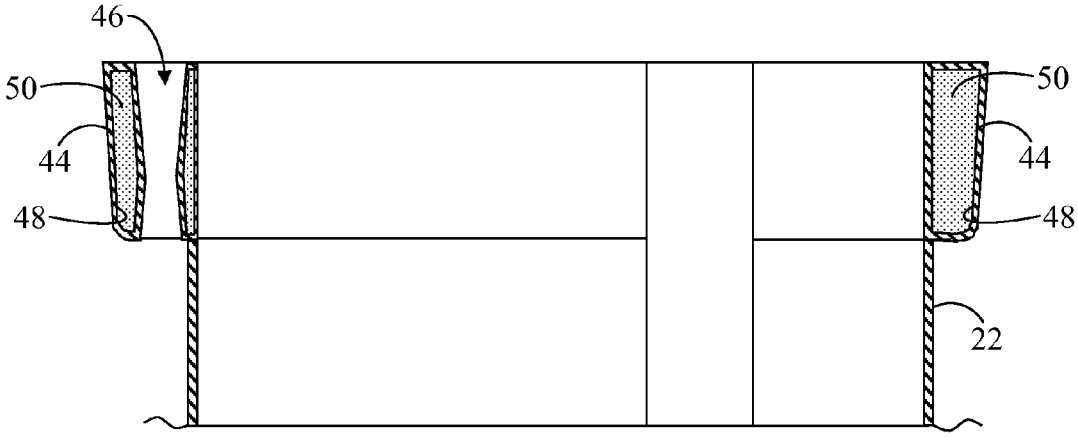
FIG. 3 shows a partial sectional view of the body along section lines 3-3 of FIG. 2.

Referring to FIGS. 2-3 in connection with FIG. 1, FIG. 2 shows a top perspective view of body 22 of animal-resistant container 20 and FIG. 3 shows a partial sectional view of body 22 along section lines 3-3 of FIG. 2. Body 22 is a walled structure having an interior volume 34 and an opening 36 for input of refuse 38 into interior volume 34. Body 22 may be formed from thermoplastic material, such as, polyethylene, polypropylene, acrylonitrile butadiene styrene (ABS), polyvinyl chloride (PVC), nylon, and the like. Body 22 may be manufactured utilizing a rotational molding process. A rotational molding technique and a thermoplastic material are highly desirable for making body 22, due to cost effective production, as well as, high durability, corrosion resistance, and light weight of the finished product. In alternative embodiments, body 22 may be manufactured using another suitable molding process, such as injection molding, blow molding, and so forth.

The walls of body 22 can be provided with ribs 40 (visible in FIG. 1) which provide stiffening to the relatively thin walls of body 22 and which provide an attachment point for latch mechanisms 30 (discussed below). Those skilled in the art will recognize that other reinforcing areas, relief areas, and so forth may be formed in body 22 to provide the desired strength and stiffness to container 20. In addition, handle supports 42 and handlebar 28 can be integrally-formed with and at the same time as the formation of body 22. Handle supports 42 support the laterally extending cylindrical handlebar 28 to which lid 26 may be pivotally attached.

Body 22 further includes a circumferential rim 44 encircling opening 36, and passages 46 are formed in body 22 during the rotational molding manufacturing process. At least a portion of latch mechanism 30 is housed in each passage 46, as will be discussed in greater detail below. Passages 46 function to protect latch mechanism 30 from an animal intruder and from inclement weather conditions.

In an embodiment, an interior cavity 48 is formed in circumferential rim 44 and is filled with a foam material 50. Foam material 50 provides reinforcement at circumferential rim 44 in order to withstand damage from teeth and claws of an animal intruder. In an embodiment, an existing or evolving "in-mold foaming process," also referred to as a rotational foam molding process, may be implemented to form circumferential rim 44 having interior cavity 48 filled with foam material 50.

In-mold foaming processes have been developed by modifying the conventional rotational molding process. These techniques allow for creating a foam layer or core in the interior of hollow moldings (that would otherwise remain hollow) in an uninterrupted manufacturing cycle and while utilizing ordinary rotational molding equipment. In-mold foaming processes offer the capacity to deliver reinforced, large-sized, complex-shaped, single-piece, foamed plastic articles that can satisfy severe service requirements and achieve improved strength-to-weight ratios.

One evolving rotational in-mold foaming process entails a one-step process in which powder (e.g., polyethylene) for the walls of body 22 and foam pellets (e.g., polyethylene mixed with a blowing agent) are loaded into the mold before the mold is closed. During the rotational molding process, the foam of the pellets fills interior cavity 48 and the powder forms the walls of body 22. Foam material 50 creates a network within interior cavity 48 that reinforces circumferential rim 44. Although, a one-step rotational in-mold foaming technique is generally described, alternative processes may be performed to create interior cavity 48 filled with foam material 50 using conventional foaming agents following rotational molding of body 22.

The illustrated configuration of body 22 having circumferential rim 44 filled with foam material is particularly suited for use at locations in which grizzly bears may be presented. However, other locations may be visited by brown bears, peccaries, dogs, or these other locations may be subject to frequently windy conditions. In such locations, a locking container may be advantageous, but need not require the additional strength. Accordingly, when the additional strength provided by foam filled circumferential rim 44 is not required, body 20 need not include the foam filled circumferential rim 44, so that costs associated with manufacturing body 22 can be reduced.

Figure 4:
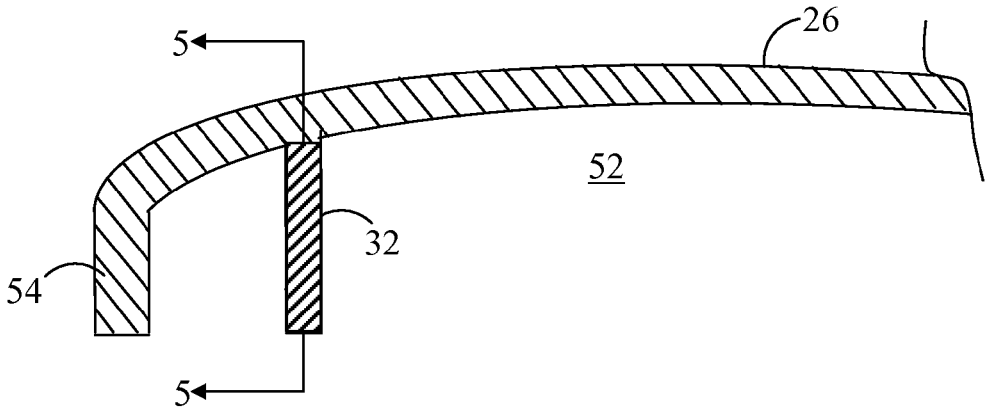
FIG. 4 shows a partial sectional view of a lid of the animal-resistant container.
Figure 5:
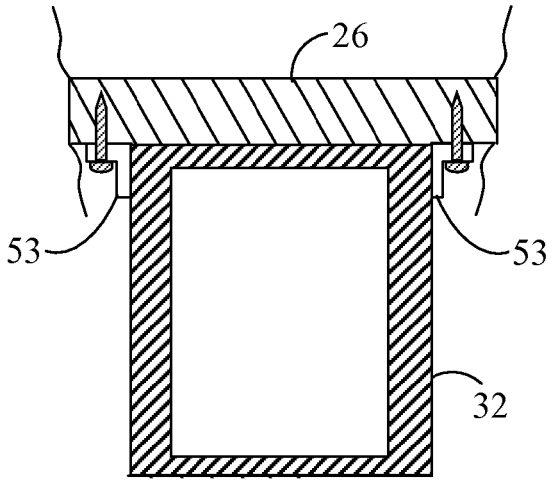
FIG. 5 shows a partial sectional view of the lid along section lines 5-5 of FIG. 4.

Referring to FIGS. 4-5 in connection with FIG. 1, FIG. 4 shows a partial sectional view of lid 26 of animal-resistant container 20 and FIG. 5 shows a partial sectional view of lid 26 along section lines 5-5 of FIG. 4. Like body 22, lid 26 may be formed from thermoplastic material using a rotational molding process.

Lid 26 may be slightly convex or dome-shaped. This convex shape produces a cavity 52 in the underside of lid 26 that is surrounded by a circumferential lip 54 of lid 26. Latch receptacles 32 are housed in cavity 52 and may be secured in lid 26 using any of a variety of bracket and/or fastener configurations 53. Alternatively, latch receptacles 32 may be integrally formed in lid 26 during rotational molding of lid 26. When lid 26 is closed on body 22, latch receptacles 32 are protected from animal intruders, as well as inclement weather conditions. In an embodiment, each latch receptacle 32 is a generally U-shaped structure to which a latch element (discussed below) of latch mechanism 30 attaches. In alternative embodiments, latch elements 32 may take on various shapes (e.g., ring-shaped) and sizes to mate or otherwise attach with the particular latch element of latch mechanism 30.

Figure 6:
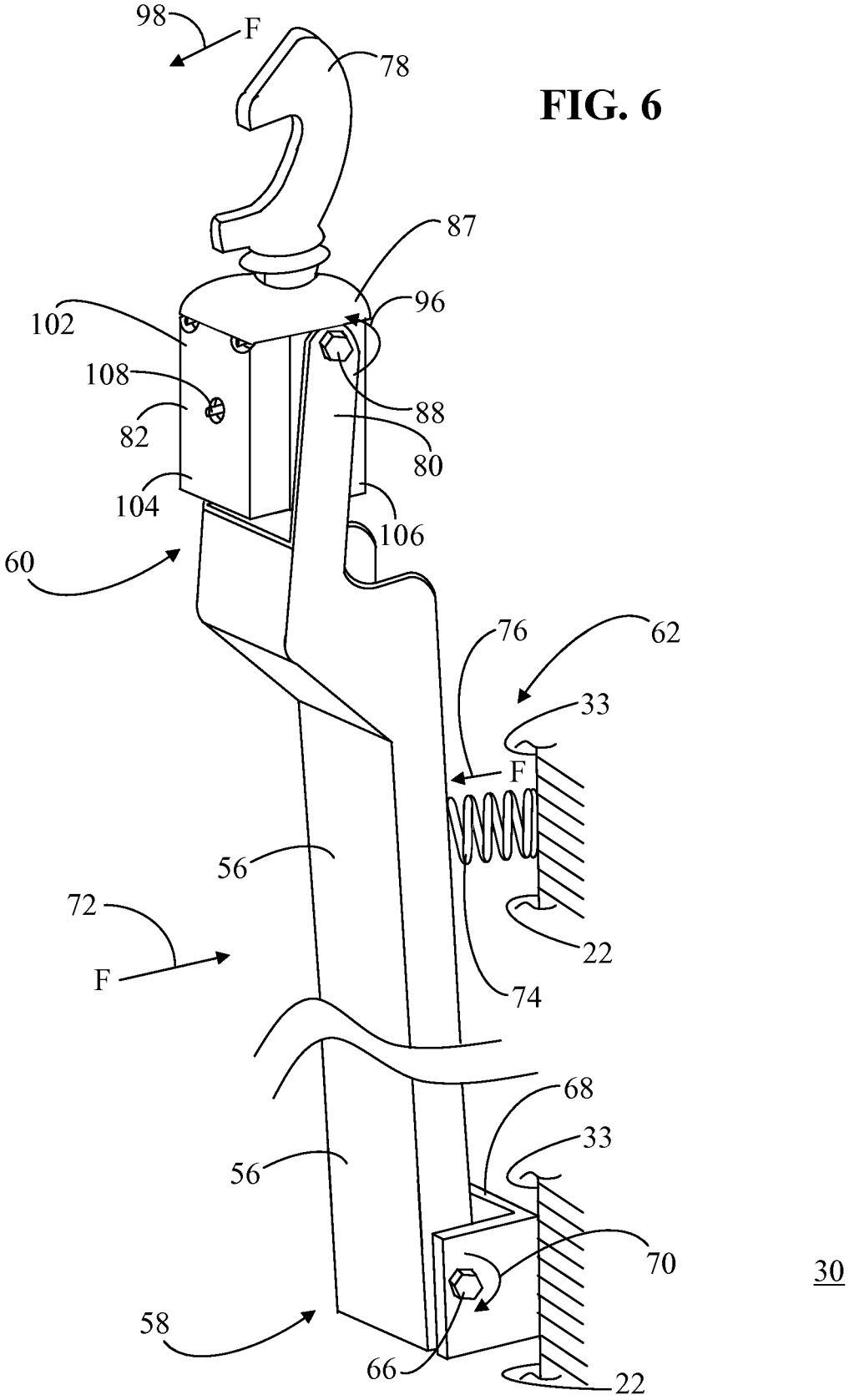
FIG. 6 shows a perspective view of a latch mechanism of the container of FIG. 1.
Figure 7:
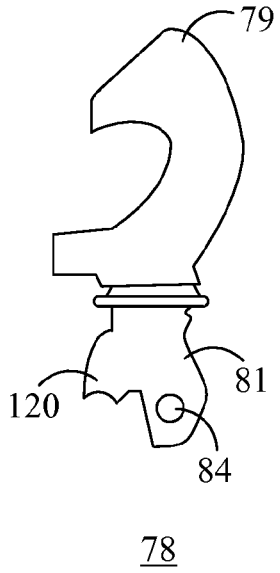
FIG. 7 shows a side view of a hook element of the latch mechanism of FIG. 6.
Figure 8:
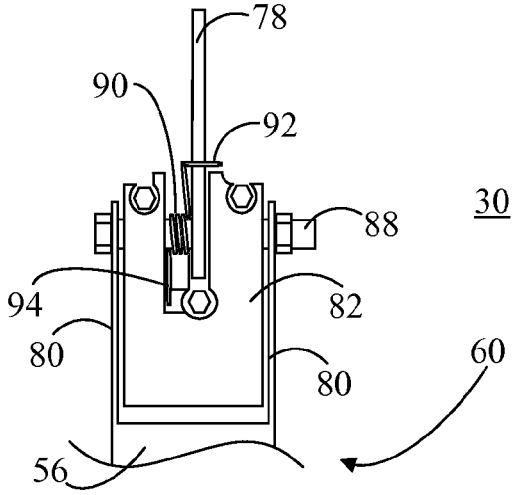
FIG. 8 shows a rear view of a portion of the latch mechanism.

Referring now to FIGS. 6-8 in connection with FIG. 1, FIG. 6 shows a perspective view of latch mechanism 30 of animal-resistant container 20. FIG. 7 shows a side view of a hook element 78 of latch mechanism 30, and FIG. 8 shows a rear view of a portion of latch mechanism 30. As mentioned above, animal-resistant container includes two latch mechanisms 30. Although only one latch mechanism 30 is described, it should be readily apparent that the following description applies equivalently to both latch mechanisms 30.

Latch mechanism 30 includes a paddle arm 56 vertically aligned with body 22 of container 20. Paddle arm 56 has as first end 58, a second end 60, and an intermediate portion 62 lying between first and second ends 58 and 60. In FIG. 6, paddle arm 56 of latch mechanism 30 appears discontinuous. It should be understood, however, that paddle arm 56 is a continuous elongated element (as shown in FIG. 1). The discontinuity shown in FIG. 6 is provided so that the features of first end 58, second end 60, and intermediate portion 62 can be more clearly visualized.

First end 58 of paddle arm 56 is pivotally coupled with exterior front surface 33 of body 22. For example, first end 58 may be located between a pair of ribs 40 (as shown in FIG. 1). A pivot pin 66 is directed through second end 58 and is secured to the pair of ribs 40. Alternatively, body 22 may include a bracket 68 (as shown in FIG. 6) extending from exterior surface 62. In this embodiment, second end 58 is located between opposing sides of bracket 68. Pivot pin 66 is directed through second end 58 and is secured to the opposing sides of bracket 68. In either configuration, pivotal movement of paddle arm 56 about pivot pin 66, as represented by an arrow 70, occurs in response to application of force (F), represented by an arrow 72, on paddle arm 56. Those skilled in the art will recognize that alternative structures may be devised that achieve pivotal movement 70 of paddle arm 56.

A spring member 74 is coupled between exterior front surface 33 of body 22 and intermediate portion 62 of paddle arm 56. In an embodiment, spring member 74 is a compression spring that offers resistance to force 72 applied to paddle arm 56. This spring force is represented by an arrow 76. Accordingly, paddle arm 56 is a spring-loaded structure that is urged outwardly from exterior front surface 33 of body 22 by spring force 76 imposed by spring member 74.

Hook element 78 is coupled to second end 60 of paddle arm 56. More particularly, hook element 78 is located between forks 80 formed in second end 60 of paddle arm 56. In addition, a tilt sensor 82 is located between forks 80.

As particularly illustrated in FIG. 7, hook element 78 includes a hook end 79 and a base end 81. An aperture 84 is formed in base end 81 of hook element 78. Likewise, and referring momentarily to FIG. 9, tilt sensor 82 has apertures 86, of which one is visible. A pivot pin 88 is directed through apertures 84 and 86 and is secured to forks 80. As shown, base end 81 of hook element 78 resides partially in tilt sensor 82. Latch mechanism 30 may include a rubber boot 87 (see FIG. 6) that seals around base end 81 of hook element 78 and around the top of housing 102 of tilt sensor 82. Boot substantially prevents dust and debris from entering tilt sensor 82, which might otherwise adversely affect the operation of latch mechanism 30. Boot 87 is only shown in FIG. 6 for exemplary purposes. Boot 87 is not shown in the remaining illustrations so that the features of latch mechanism 30 and tilt sensor 82 can be more readily visualized.

As particularly illustrated in FIG. 8, a spring member 90 is wound around pivot pin 88. A first spring end 92 of spring member 90 engages with hook element 78 and a second spring end 94 of spring member 90 engages with tilt sensor 82. In an embodiment, hook element 78 can pivot about pivot pin 88, as represented by an arrow 96. However, tilt sensor 82 is largely prevented from pivoting about pivot pin 88 by its contact with an inner surface of passage 46 (see FIGS. 12, 15, and 17). Spring member 90 applies a spring force (F), represented by an arrow 98, to hook element 78. Under certain conditions, as will be discussed in detail below, spring force 98 causes hook element 78 to pivot about pivot pin 88.

Figure 9:
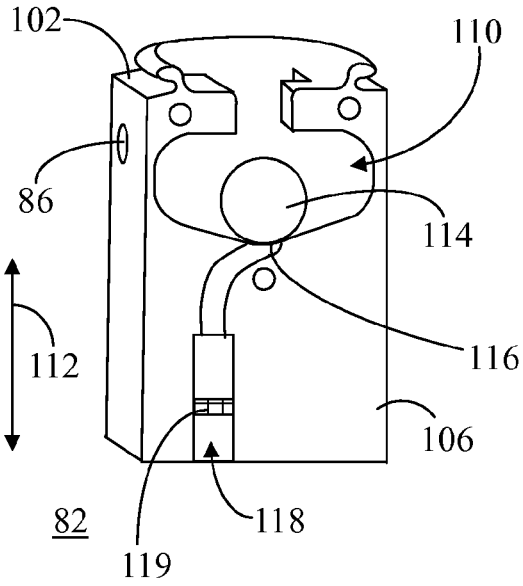
FIG. 9 shows a partial perspective view of a tilt sensor of the animal-resistant container.
Figure 10:
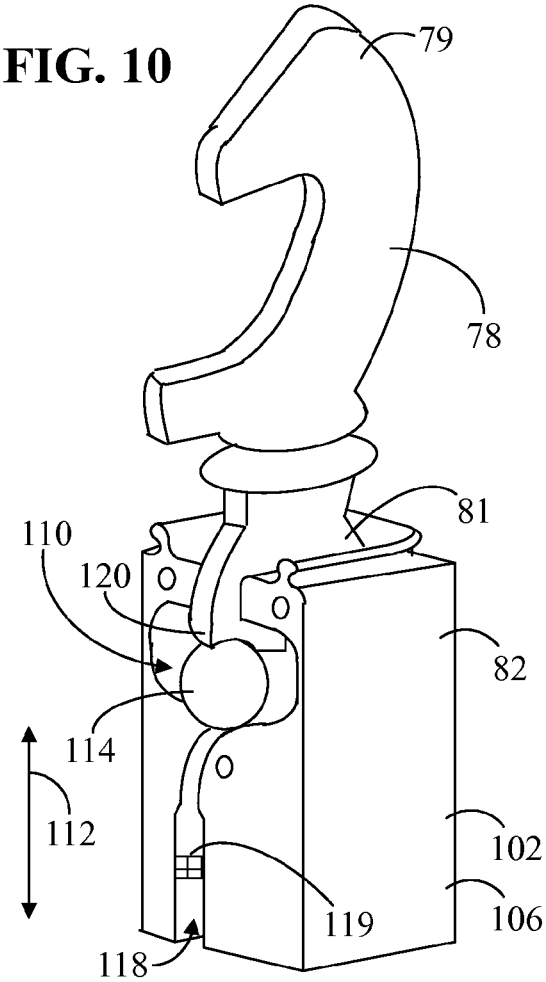
FIG. 10 shows a perspective view of the hook element of FIG. 7 seated in the tilt sensor of FIG. 9.

Referring to FIGS. 9 and 10 in connection with FIG. 6, FIG. 9 shows a partial perspective view of tilt sensor 82 and FIG. 10 shows a perspective view of hook element 78 seated in tilt sensor 82. Tilt sensor 82 is configured to detect movement of body 22 (FIG. 1) of animal-resistant container 20 (FIG. 1) away from an upright position, such as the position of container 20 illustrated in FIG. 1. Animal-resistant container 20 can move away from an upright position when an automated, mechanical arm of a refuse truck grasps container 20 to empties its contents. This situation is an acceptable circumstance which will be discussed in connection with FIGS. 14-16.

However, animal-resistant container 20 can also move away from its upright position when a large animal, such as a bear, peccary, and the like, knocks it over in an attempt to get to refuse 38 (FIG. 2) inside container 20. Alternatively, weather conditions, such as high winds could blow it over. In any instance, barring intentional tilting due to refuse collection, it is critical that lid 26 does not open to expose refuse 38 to intruders. In an embodiment, when tilt sensor 82 detects movement of container 20 away from an upright position, excluding during refuse collection (discussed below), latch mechanism 30 is prevented from disengagement with latch receptacle 32 (FIG. 4).

Tilt sensor 82 includes a housing 102 formed from a first housing section 104 and a second housing section 106 coupled together via at least one fastener 108. Housing 102 is formed from two sections 104 and 106 so that an interior of tilt sensor 82 may be accessed. In FIGS. 9 and 10, first housing section 104 has been removed to reveal the interior of tilt sensor 82. Although sections 104 and 106 are illustrated as being coupled together via fastener 108, it should be understood that in alternative embodiments, sections 104 and 106 may be welded, glued, or otherwise coupled together.

Housing 102 includes an arcuate channel 110 extending approximately transverse to a longitudinal dimension 112 of housing 102. Additionally, tilt sensor 82 includes a ball 114 configured to roll in arcuate channel 110. Arcuate channel 110 exhibits the shape of an inverted arch with the approximate center of channel 110 being at a bottom 116 of arcuate channel 110. When container 20 is upright, the shape of arcuate channel 110 compels ball 114 to roll to a centered position, i.e., bottom 116, in arcuate channel 110. Similarly, ball 114 rolls to an uncentered position away from bottom 116 when container 20 is tilted or tipped. As illustrated, housing 102 may additionally include a passage 118 extending between arcuate channel 110 and an exterior of housing 102. Passage 118 can facilitate the drainage of moisture, from rain, snow, condensation, and so forth, out of arcuate channel 110 should this moisture get into channel 110. A filter 119 may optionally be installed in passage 118 to prevent dust from entering arcuate channel 110 that might otherwise adversely affect the operation of tilt sensor 82.

Figure 11:
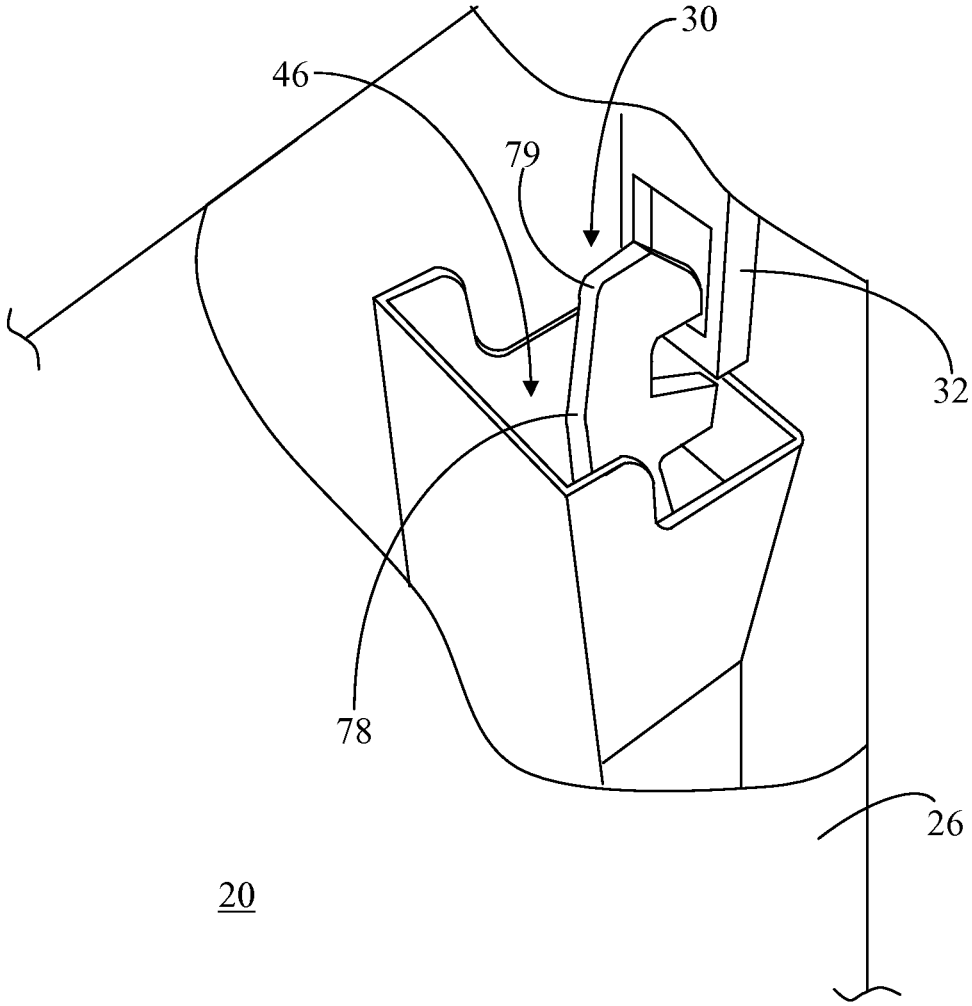
FIG. 11 shows a partial perspective top view of the container with the latch mechanism of FIG. 6 engaged with a latch receptacle formed in the lid of the container.

Referring to FIG. 11 in connection with FIG. 10, FIG. 11 shows a partial perspective top view of container 20 with latch mechanism 30 engaged with latch receptacle 32 formed in lid 26. It should be noted that a portion of lid 26 is cut away in FIG. 11 to reveal hook element 78 residing in passage 46. Hook end 79 of hook element 78 is normally attached to latch receptacle 32, as shown in FIG. 11.

With reference back to FIGS. 7 and 10, hook element 78 is aligned with longitudinal dimension 112 of housing 102. Base end 81 of hook element 78 includes a bumper 120 extending into arcuate channel 110. Bumper 120 enables the disengagement of hook end 79 from latch receptacle 32 under particular circumstances, and prevents the disengagement of hook end 79 from latch receptacle 32 under other circumstances, as discussed in connection with subsequent FIGS. 12-18.

Figure 12:
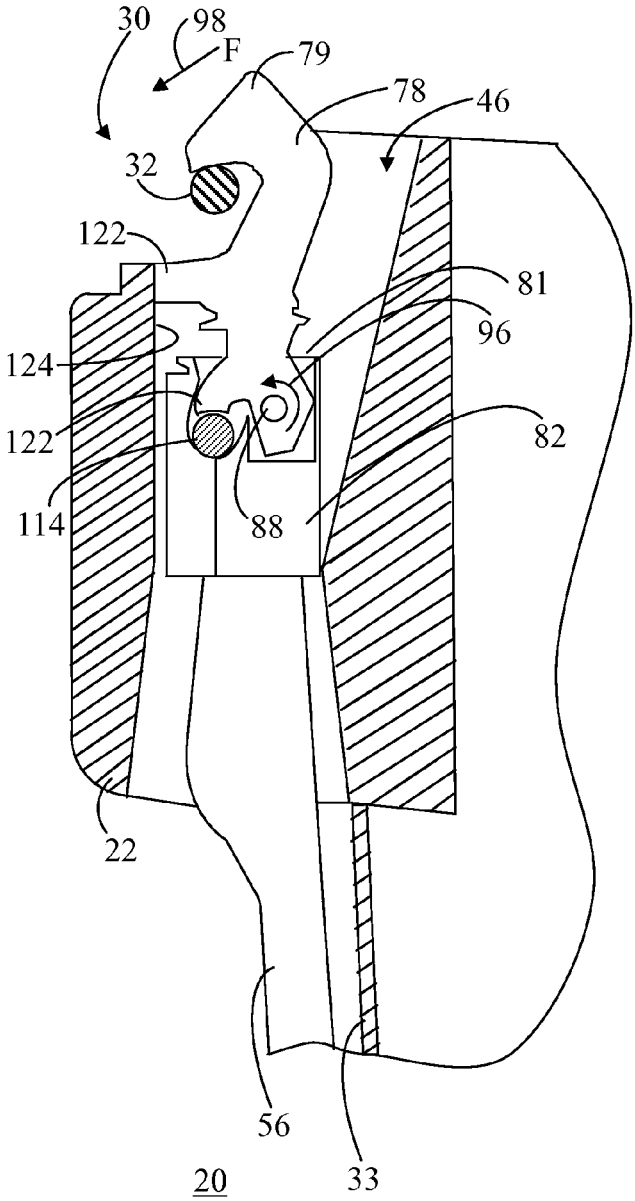
FIG. 12 shows a partial side view of the container with the latch mechanism engaged with the latch receptacle when the container is in an upright position.
Figure 13:
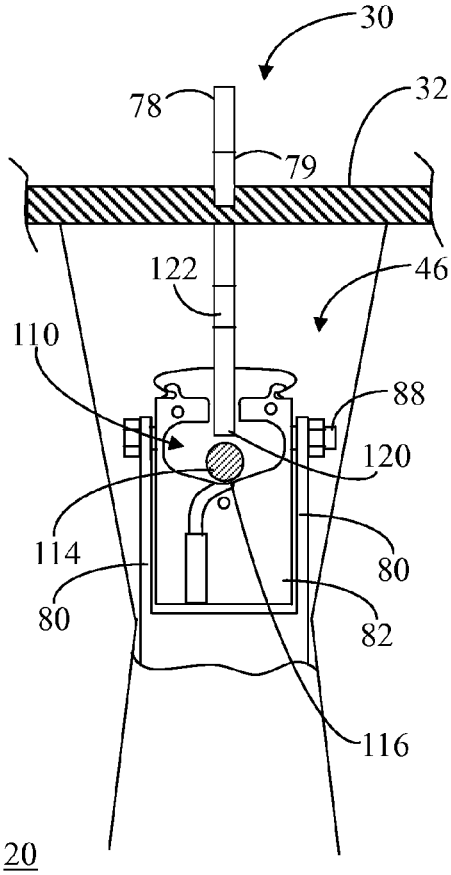
FIG. 13 shows a partial front view of the container with the latch mechanism engaged with the latch receptacle when the container is in the upright position.

Referring now to FIGS. 12 and 13, FIG. 12 shows a partial side view of container 20 with latch mechanism 30 engaged with latch receptacle 32 when container 20 is in an upright position, and FIG. 13 shows a partial front view of container 20 with latch mechanism 30 engaged with latch receptacle 32 when container 20 is in the upright position. Lid 26 (FIG. 1) is not shown so that latch mechanism 30 and latch receptacle 32 are visible.

Hook element 78 and tilt sensor 82 are housed in passage 46 formed in body 22 of container 20. Paddle arm 56 extends outside of and below passage 46 along exterior front surface 33 of body 22. Ball 114 of tilt sensor 82 is centered at bottom 116 of arcuate channel 110. Bumper 120 formed in base end 81 of hook element 78 overlies, but does not come into contact with ball 114 when hook element 78 is engaged with latch receptacle 32. In an embodiment, hook element 78 includes a forwardly extending stop 122 that limits pivotal movement 96 of hook element 78 about pivot pin 88.

It should be recalled that spring member 90 (FIG. 8) imposes spring force 98 on hook element 78 that causes hook element 78 to pivot about pivot pin 88. When container 20 is in an upright position and force 72 (FIG. 6) is not applied to paddle arm 56, spring force 98 urges hook element 78 forward so that stop 122 to abuts an inner surface 124 of passage 46. Hook element 78 is designed so that bumper 120 does not contact ball 114 when stop 122 abuts inner surface 124 and when container 20 is upright so that ball 114 is free to move in arcuate channel 110. Thus, ball 114 will roll out of the centered position, i.e., away from bottom 116, in response to container 20 being tilted or tipped by an animal intruder.

Figure 14:
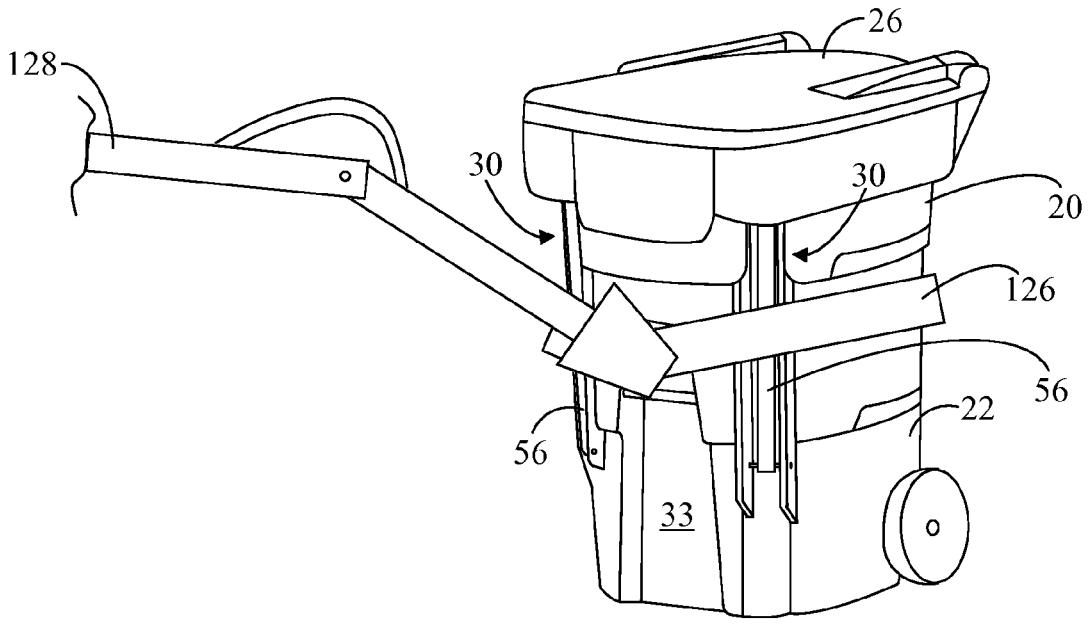
FIG. 14 shows a perspective view of the animal-resistant container being lifted by a gripping arm of a refuse pickup vehicle.
Figure 15:
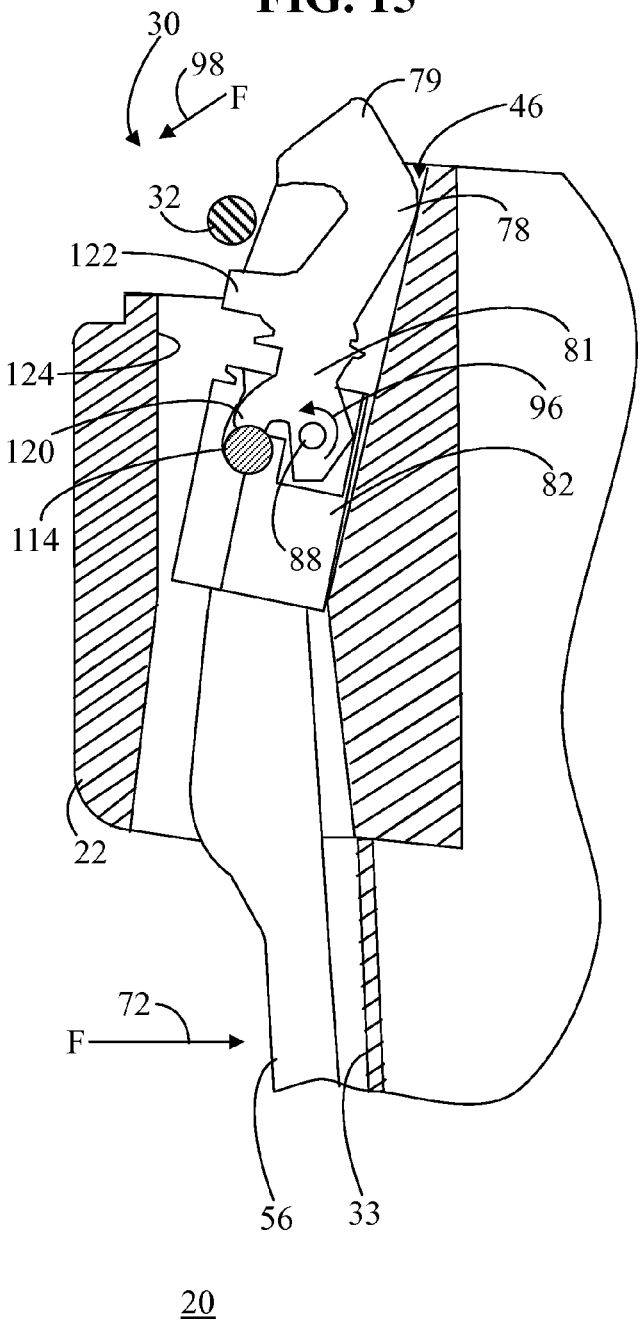
FIG. 15 shows a partial side view of the container with the latch mechanism disengaged from the latch receptacle when the gripping arm of a refuse pickup vehicle attaches to the container.
Figure 16:
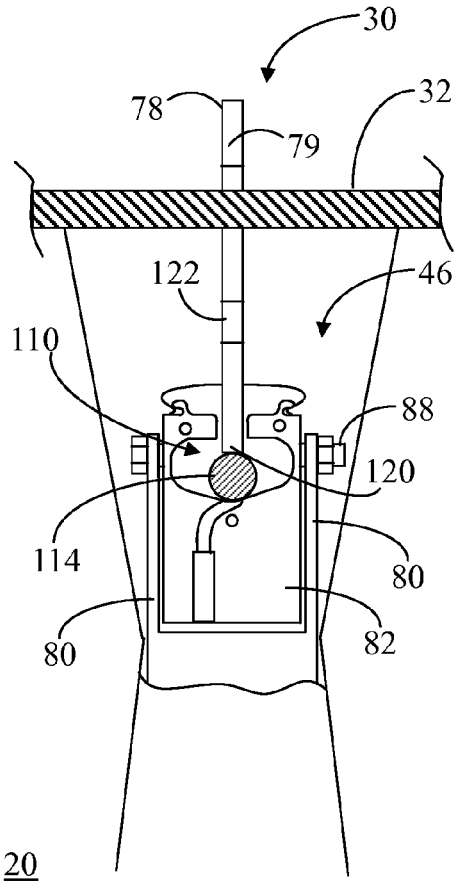
FIG. 16 shows a partial front view of the container with the latch mechanism disengaged with the latch receptacle when the gripping arm of a refuse pickup vehicle attaches to the container.

Referring to FIGS. 14-16, FIG. 14 shows a perspective view of animal-resistant container 20 being lifted by a gripping arm 126 of a refuse pickup vehicle 128. FIG. 15 shows a partial side view of container 20 with latch mechanism 30 disengaged from latch receptacle 32 when gripping arm 126 of refuse pickup vehicle 128 attaches to container 20. FIG. 16 shows a partial front view of container 20 with latch mechanism 30 disengaged from latch receptacle 32 when gripping arm 126 attaches to container 20.

Animal-resistant container 20 is compatible with fully-automated collection systems. Container 20 preferably includes two latch mechanisms 30 and corresponding latch receptacles 32 adapted to face refuse pickup vehicle 128. During refuse collection, gripping arm 126 is remotely controlled by the driver of refuse pickup vehicle 128 and is manipulated to encircle and clamp onto body 22 of container 20, and subsequently lift container 20. This clamping operation results in a manual depression of each paddle arm 56 toward exterior front surface 33 of body 20 with sufficient force 72 to release each latch mechanism 30 from its corresponding latch receptacle 32 in order to enable access to refuse 38 (FIG. 2) in interior volume 34 (FIG. 2).

Both paddles arms 56 are actuated concurrently by gripping arm 126 to concurrently release each latch mechanism 30 from its corresponding latch receptacle 32. An individual human user of container 20 can also access interior volume 34 by manually depressing both paddles arms 56. Manual depression of only one paddle arm 56 may release one latch mechanism 30 but will not release the other latch mechanism 30. This dual latch and release configuration prevents an animal intruder from gaining access to interior volume 34 by actuating only one paddle arm 56. Paddle arms 56 may optionally operate with a spring lock system (not shown) that allows the individual to unlatch and retain each latch mechanism 30 in an unlatched position temporarily while the individual places refuse 38 (FIG. 2) in container 20. Once lid 26 closes, such a spring lock system will release so that latch mechanisms 30 again re-engage with latch receptacles 32.

Although not visible, container 20 may further include an emergency release mechanism attached to each hook element 78. An emergency release mechanism may be provided so that should a child become accidentally trapped inside container 20, that child could escape from container 20. For example, an emergency release mechanism may be a light cable tethered to hook end 79 of each hook element 78 that is accessible from the inside of container 20. A trapped individual could simply pull on the cable to release hook elements 78 from latch receptacles 32 and thereby affect his or her escape.

As shown in FIGS. 15 and 16, force 72 is applied to paddle arm 56. Since container 20 includes two latch mechanisms 30, the following discussion applies equally to both so that gripper arm 126 concurrently applies force 72 to both paddle arms 56. With ball 114 still centered at bottom 116 of arcuate channel, force 72 moves paddle arm 56 toward exterior front surface 33 of body 22. Spring force 98 from spring member 90 (FIG. 8) results in pivotal movement 96 of hook element 78 so that bumper 120 now contacts ball 114. This contact between bumper 120 and ball 114 prevents further pivoting motion of hook element 78 so that manual depression of paddle arm 56 pushes hook end 79 away from latch receptacle 32, thereby unlatching hook element 78 from latch receptacle 32.

When both hook elements 78 are disengaged from both latch receptacles 32, lid 26 (FIG. 14) can now open. Refuse pickup vehicle 128 then lifts animal-resistant container 20 from the curbside, dumps refuse 38 (FIG. 2) into truck 128, and returns container 20 to the curbside. Typically, return of container 20 to the curbside causes lid 26 to swing closed. When lid 26 closes, hook elements 78 will automatically engage with latch receptacles 32 so that lid 26 is again secured onto body 22 of container 20. This engagement occurs due to spring force 76 (FIG. 6) outwardly urging paddle arm 56 from exterior front surface 33 of body 22.

Referring now to FIGS. 17-18, FIG. 17 shows a partial side view of 20 container with latch mechanism 30 engaged with latch receptacle 32 when container 20 is tipped away from the upright position. FIG. 18 shows a partial front view of container 20 with latch mechanism 30 engaged with latch receptacle 32 when container 20 is tipped away from the upright position. Animal-resistant container 20 may be subject to attack by an animal intruder seeking to access the contents of container 20. Large animals, such as bears, peccaries, and the like have sufficient size and strength to tip over a container in order to access its contents. Furthermore, these animals quickly learn that they can receive a food reward when they tip such containers over. A tilting force (F) is represented by an arrow 130 in FIG. 18. Although, FIG. 18 shows a lateral, or sideways, tilt, the shape and configuration of arcuate channel 110 enables detection of tilt of container 20 in forward and backward directions as well.

It should be recalled from the discussion associated with FIGS. 12 and 13, that when container 20 is in an upright position, latch element 78 is engaged with latch receptacle 32. However, bumper 120 is not in contact with ball 114. Accordingly, ball 114 can move freely in arcuate channel 110 in response to movement of animal resistant container 20. As such, when tilting force 130 is applied to container 20, ball 114 rolls away from bottom 116 of arcuate channel 110.

In response to the movement of ball 114 spring force 98 imposed on hook element 78 from spring member 90 (FIG. 8) causes hook element 78 to pivot about pivot pin 88. However, ball 114 no longer underlies bumper 120, as represented by the absence of ball 114 in FIG. 17. Accordingly, spring force 98 urges hook element 78 forward so that hook end 79 is securely engaged with latch receptacle 32. Consequently, force 72 applied to paddle arm 56, will not push hook end 79 away from latch receptacle 32 in order to unlatch hook element 78. Rather, in the absence of ball 114 in bottom 116 of arcuate channel 110, manual depression of paddle arm will only cause additional pivotal movement 96 of hook element 78 to retain hook end 79 secured to latch receptacle 32.

It should be observed that when hook element 78 pivots forward, bumper 120 extends further into arcuate channel 110. With the presence of bumper 120 in arcuate channel, ball 114 cannot roll back to bottom 116 of arcuate channel 110 until container 20 is moved back into the upright position and both latch elements 78 are manually manipulated. Thus, latch elements 78 will remain engaged with corresponding latch receptacles 32 until human intervention thereby preventing a persistent animal intruder from gaining access.

In summary, the present invention teaches an animal-resistant container useful for receiving and holding garbage, trash, recyclable items, and the like. The animal-resistant container is manufactured utilizing a rotational molding process to achieve cost effective production, as well as, a high durability, corrosion resistant, and light weight finished product. The container can include reinforcing ribs and a foam reinforced circumferential rim for additional strength. The animal-resistant container further includes a latch system configured to inhibit an animal, and especially large animals such as bears, peccaries, and the like, from accessing the contents of the container. The latch system includes two latch mechanisms secured in the container body and two corresponding latch receptacles formed in the container lid. The latch mechanisms engage with the latch receptacles to secure the lid to the body. Additionally, the latch mechanisms automatically engage with the latch receptacles so that a user need not deliberately re-engage the latches after placing refuse in the container. The latch mechanisms can be actuated by an automated, mechanical gripping arm of a refuse pickup vehicle so that the contents of the container can be emptied during automated collection. A tilt sensor detects tilting or tipping movement of the container, and the latch mechanisms are prevented from actuation upon detection of this tilting movement so that an animal intruder cannot tip over the container and subsequently gain entry into the container.

Although the preferred embodiments of the invention have been illustrated and described in detail, it will be readily apparent to those skilled in the art that various modifications may be made therein without departing from the spirit of the invention or from the scope of the appended claims. For example, various tilt sensors may be adapted to detect tipping movement of the container and subsequently communicate this information to the latch mechanisms so that the latch mechanisms cannot disengage from the latch receptacles.

What is claimed is:

1. An animal-resistant container comprising:

a body having an interior volume and an opening for input of refuse into said interior volume;

a lid covering said opening;

a latch mechanism secured in said body, said latch mechanism comprising a hook element, said hook element including a hook end and a base end, said base end having a bumper;

a latch receptacle secured in said lid, said hook end of said latch mechanism being engaged with said latch receptacle to secure said lid to said body; and a tilt detector coupled with said latch mechanism for detecting movement of said body away from an upright position, said tilt detector comprising a housing and a ball, said hook element being aligned with a longitudinal dimension of said housing, said housing having an arcuate channel extending approximately transverse to said longitudinal dimension of said housing, said ball being configured to roll in said arcuate channel in response to a position of said body, wherein said ball is in a centered position in said arcuate channel when said body is in an upright position to enable release of said latch mechanism from said latch receptacle, and when said body is tilted away from said upright position, said ball rolls in said arcuate channel to an uncentered position such that said bumper pivots into said arcuate channel, said bumper being positioned in said arcuate channel to prevent return of said ball to said centered position and thereby prevent release of said latch mechanism from said latch receptacle.

2. An animal-resistant container as claimed in claim 1 wherein said body is a molded element, said molded element including a molded passage in which at least a portion of said latch mechanism is housed.

3. An animal-resistant container as claimed in claim 1 wherein said latch mechanism comprises:

a paddle arm vertically aligned with said body, said paddle arm having a first end and a second end, said first end being pivotally coupled with an exterior surface of said body, and an intermediate portion of said paddle arm being coupled with said exterior surface of said body by a spring member, said paddle arm being urged outwardly from said exterior surface of said body by said spring member; and said hook element being coupled to said second end of said paddle arm, said hook end of said hook element being engaged with said latch receptacle when said paddle arm is urged outwardly from said exterior surface of said body by said spring member, and manual depression of said paddle arm toward said exterior surface releases said hook end from said latch receptacle.

4. An animal-resistant container as claimed in claim 3 wherein said body comprises a passage located proximate said opening in which said hook element is housed and said paddle arm extends outside of and below said passage.

5. An animal-resistant container as claimed in claim 1 wherein said latch mechanism is a first latch mechanism, said latch receptacle is a first latch receptacle, and said container further comprises:

a second latch mechanism secured in said body; and a second latch receptacle secured in said lid, said second latch mechanism being engaged with said second latch receptacle to secure said lid to said body and prevent access to said interior volume, wherein both of said first and second latch mechanisms are configured to be actuated concurrently to concurrently release said first and second latch mechanisms from respective ones of said first and second latch receptacles in order to enable access to said interior volume.

6. An animal-resistant container as claimed in claim 5 wherein:

said body has an exterior front surface;

said first latch mechanism includes a first spring-loaded paddle arm; and said second latch mechanism includes a second spring-loaded paddle arm spaced apart from said first spring-loaded paddle arm, each of said first and second spring-loaded paddle arms being located at said exterior front surface, and each of said first and second spring-loaded paddle arms being configured to be depressed to release said first and second latch mechanisms.

7. An animal-resistant container as claimed in claim 1 wherein said arcuate channel exhibits a shape of an inverted arch with said centered position being at a bottom of said inverted arch.

8. An animal-resistant container as claimed in claim 1 wherein said lid is a molded element, said molded element including a molded cavity in which said latch receptacle is housed.

9. An animal-resistant container as claimed in claim 1 wherein said body is a molded element having a circumferential rim encircling said opening, said circumferential rim having an interior cavity filled with a foam material.

10. An animal-resistant container comprising:

a body having an interior volume and an opening for input of refuse into said interior volume;

a lid covering said opening;

a first latch mechanism secured in said body;

a second latch mechanism secured in said body, each of said first and second latch mechanisms comprising a hook element, said hook element including a hook end and a base end, said base end having a bumper ;

a first latch receptacle secured in said lid;

a second latch receptacle secured in said lid, said hook end of said first latch mechanism being engaged with said first latch receptacle and said hook end of said second latch mechanism being engaged with said second latch receptacle to secure said lid to said body and prevent access to said interior volume; and a tilt detector system coupled with said first and second latch mechanisms for detecting movement of said body away from an upright position, said tilt detector system comprising a first tilt detector and a second tilt detector, each of said first and second tilt detectors including a housing and a ball, said housing having an arcuate channel extending approximately transverse to a longitudinal dimension of said housing, said ball being configured to roll in said arcuate channel in response to a position of said body, wherein said ball is in a centered position in said arcuate channel when said body is in said upright position to enable release of said first and latch mechanisms from respective ones of said first and second latch receptacles, and when said body is tilted away from said upright position, said ball rolls in said arcuate channel to an uncentered position such that said bumper pivots into said arcuate channel, said bumper being positioned in said arcuate channel to prevent return of said ball to said centered position and thereby prevent release of said latch mechanism from said latch receptacle.

11. An animal-resistant container as claimed in claim 10 wherein each of said first and second latch mechanisms comprises:

a paddle arm vertically aligned with said body, said paddle arm having a first end and a second end, said first end being pivotally coupled with an exterior surface of said body, and an intermediate portion of said paddle arm being coupled with said exterior surface of said body by a spring member, said paddle arm being urged outwardly from said exterior surface of said body by said spring member; and said hook element being coupled to said second end of said paddle arm, said hook end of said hook element being engaged with said one of said first and second latch receptacles when said paddle arm is urged outwardly from said exterior surface of said body by said spring member, and manual depression of said paddle arm toward said exterior surface releases said hook element from said said one of said first and second latch receptacles.

12. An animal-resistant container as claimed in claim 10 wherein:

said body comprises a first passage and a second passage, each of said first and second passages being located proximate said opening, at least a portion of said first latch mechanism is housed in said first passage, and at least a portion of said second latch mechanism is housed in said second passage; and said lid includes a cavity, and each of said first and second latch receptacles is housed in said cavity.

* * * * *